US006234189B1

(12) United States Patent
Koch

(10) Patent No.: US 6,234,189 B1
(45) Date of Patent: May 22, 2001

(54) GAS VALVE WITH THERMOELECTRIC SAFETY SHUTOFF

(75) Inventor: Jürgen Koch, Attendorn (DE)

(73) Assignee: AGT Gas Technology GmbH, Attendorn (DE)

( * ) Notice: Subject to any disclaimer, the term of this patent is extended or adjusted under 35 U.S.C. 154(b) by 0 days.

(21) Appl. No.: 09/437,461

(22) Filed: Nov. 10, 1999

(30) Foreign Application Priority Data

Nov. 12, 1998 (DE) ..... 198 52 128

(51) Int. Cl.[7] ..... F23D 14/72
(52) U.S. Cl. ..... 137/66; 137/614.11; 251/111
(58) Field of Search ..... 137/65, 66, 614.11; 251/111; 431/78, 79, 80

(56) References Cited

U.S. PATENT DOCUMENTS 3,763,875 * 10/1973 Mobus et al. ..... 137/66
5,094,259 * 3/1992 Hsu ..... 137/66
5,622,200 * 4/1997 Schulze ..... 137/66
5,718,256 * 2/1998 Buezis et al. ..... 137/66
5,988,215 * 11/1999 Martin et al. ..... 137/613

* cited by examiner

*Primary Examiner*—Kevin Lee
(74) *Attorney, Agent, or Firm*—Herbert Dubno; Andrew Wilford

(57) ABSTRACT

A gas-valve assembly has a housing having an inlet port, an outlet port, and a passage extending between the ports and defining an axis, a valve plug rotatable about the axis in the housing in the passage between a closed end position blocking flow between the ports and an open end position permitting flow between the ports, and a control knob rotatable on the housing and angularly coupled to the valve plug. Structure engaged between the knob and the housing prevents the knob from moving axially relative to the housing while permitting rotation of the knob about the axis relative to the housing. A safety valve in the housing has a valve body displaceable axially between a closed position blocking flow through the passage and an open position permitting flow through the passage. An actuator including a cam with a spiral cam surface generally centered on the axis and a cam follower riding on the cam surface and coupled to the knob displaces the safety-valve body between its positions on rotation of the knob about the axis.

15 Claims, 4 Drawing Sheets

GAS VALVE WITH THERMOELECTRIC SAFETY SHUTOFF

FIELD OF THE INVENTION

The present invention relates to a gas valve. More particularly this invention concerns such a valve used on a household or commercial heater or stove and provided with a thermoelectric safety system that shuts off flow through the valve if the burner or the like controlled by it goes out.

BACKGROUND OF THE INVENTION

It is standard to provide a gas-control valve assembly with a safety-shutoff system that comprises a thermoelectric sensor positioned at the flame fed by the valve, a safety cutoff valve, and a solenoid system that holds the cutoff valve open so long as the sensor detects heat. To start, the valve knob is typically pressed in against a spring force to override the safety cutoff so that gas can flow to the burner and be ignited, whereupon the heat detected by the sensor will actuate the solenoid to hold the safety valve open and allow the knob to be released. If the burner does not ignite, releasing the knob will cut off gas flow, and if the burner goes out at a later time, the safety cutoff will close to cut off gas flow.

While such a system is well known and considered fairly intuitive and user-friendly, it has the disadvantage that the valve-control knob must be offset sufficiently from the control panel or the like it is mounted on that it can be depressed to override the safety shutoff. This creates an unattractive appearance with the control knob normally standing out, well offset from the surface it is mounted on.

German 29 43 996 proposes a rotary system where the safety shutoff is operated by a cylindrically tubular cam so that rotary action effects the necessary axial displacement to open the shutoff. While operating this system is somewhat easier, not requiring the so-called biaxial movement of both pressing and turning the knob, the knob still moves axially and thus presents the unattractive standing-off appearance of the prior-art systems.

OBJECTS OF THE INVENTION

It is therefore an object of the present invention to provide an improved gas valve with a thermoelectric safety shutoff.

Another object is the provision of such an improved gas valve with a thermoelectric safety shutoff which overcomes the above-given disadvantages, that is which uses only rotary movement of the knob to override the safety shutoff and adjust flow through the main valve.

SUMMARY OF THE INVENTION

A gas-valve assembly has according to the invention a housing having an inlet port, an outlet port, and a passage extending between the ports and defining an axis, a valve plug rotatable about the axis in the housing in the passage between a closed end position blocking flow between the ports and an open end position permitting flow between the ports, and a control knob rotatable on the housing and angularly coupled to the valve plug. Structure engaged between the knob and the housing prevents the knob from moving axially relative to the housing while permitting rotation of the knob about the axis relative to the housing. A safety valve in the housing has a valve body displaceable axially between a closed position blocking flow through the passage and an open position permitting flow through the passage. An actuator including a cam with a spiral cam surface generally centered on the axis and a cam follower riding on the cam surface and coupled to the knob displaces the safety-valve body between its positions on rotation of the knob about the axis.

Thus with this system the knob does not move axially at all so that it can sit flush on the control panel. The result is an extremely neat appearance that also does not trap dirt or expose the knob to damage.

The gas-valve assembly further has according to the invention formations inhibiting rotation of the cam about the axis and rotationally coupling the cam follower with the knob. In addition an axially displaceable stem carrying the cam follower has an end engageable with the safety-valve body. The abutment projects radially outward from the stem and the cam is limitedly axially displaceable in the housing. A spring braced axially between the abutment and the stem allows limited axial movement of the stem relative to the abutment and another spring braced axially between the cam and the housing allows limited axial movement of the cam in the housing. The spring between the cam and the housing urges the cam axially outward toward the knob while the spring between the abutment and the stem urges the abutment axially outward toward the knob and away from the safety valve.

The formations inhibiting rotation of the cam in the housing include an axially extending slot in the cam and a radially projecting part of the housing extending into the slot. Furthermore axially extending and interfitting formations angularly couple the knob to the plug. In the open end position the cam follower is at an end of the cam surface. Furthermore the actuator only displaces the safety-valve body into the respective open position in the open end position of the valve plug.

According to the invention a controller including an electromagnet temporarily holds the safety-valve body in the respective open position for a brief time after displacement of the safety-valve body into the open position by the actuator.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
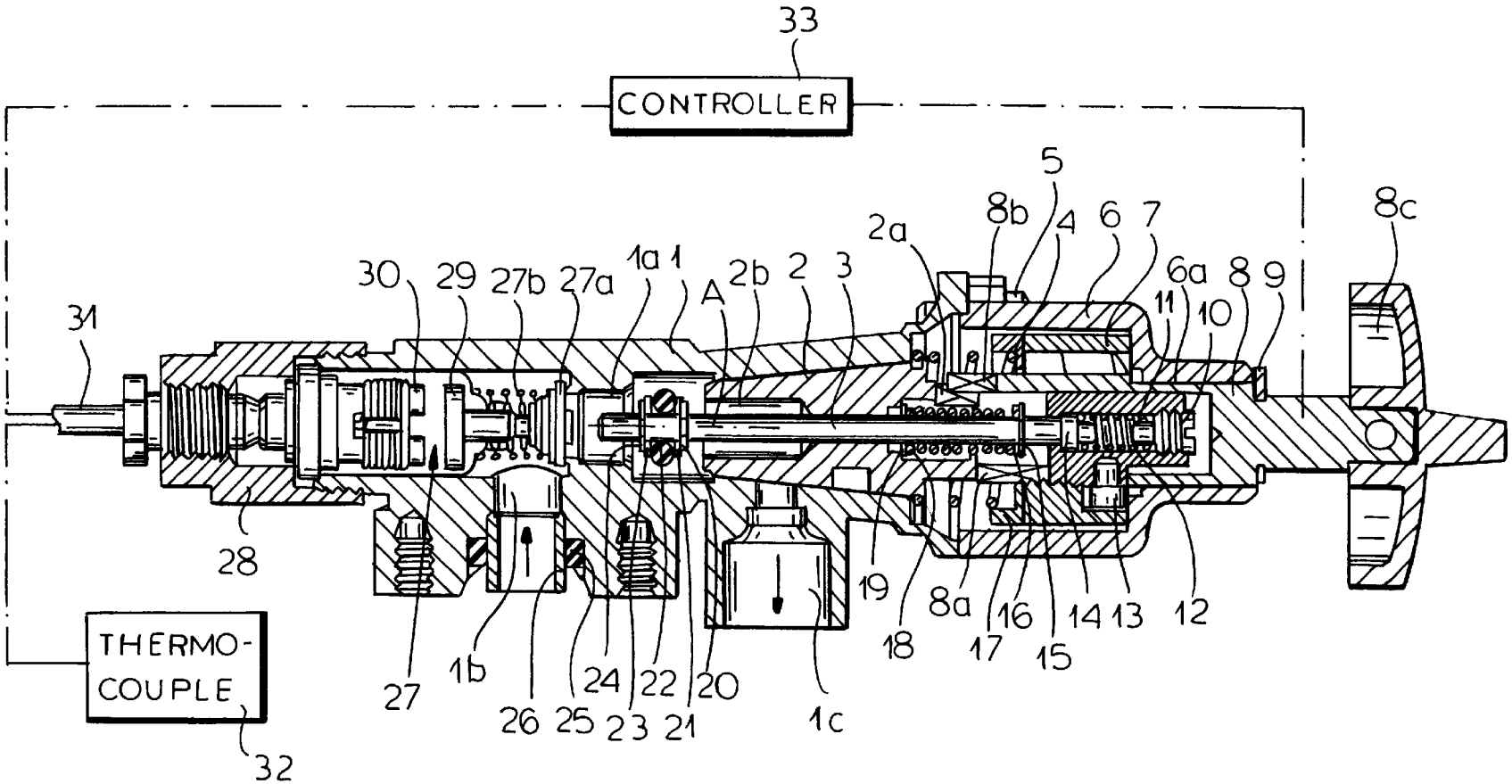
FIG. 1 is a partly diagrammatic axial section through the gas valve according to the invention with both the main valve and safety valve closed.
Figure 2:
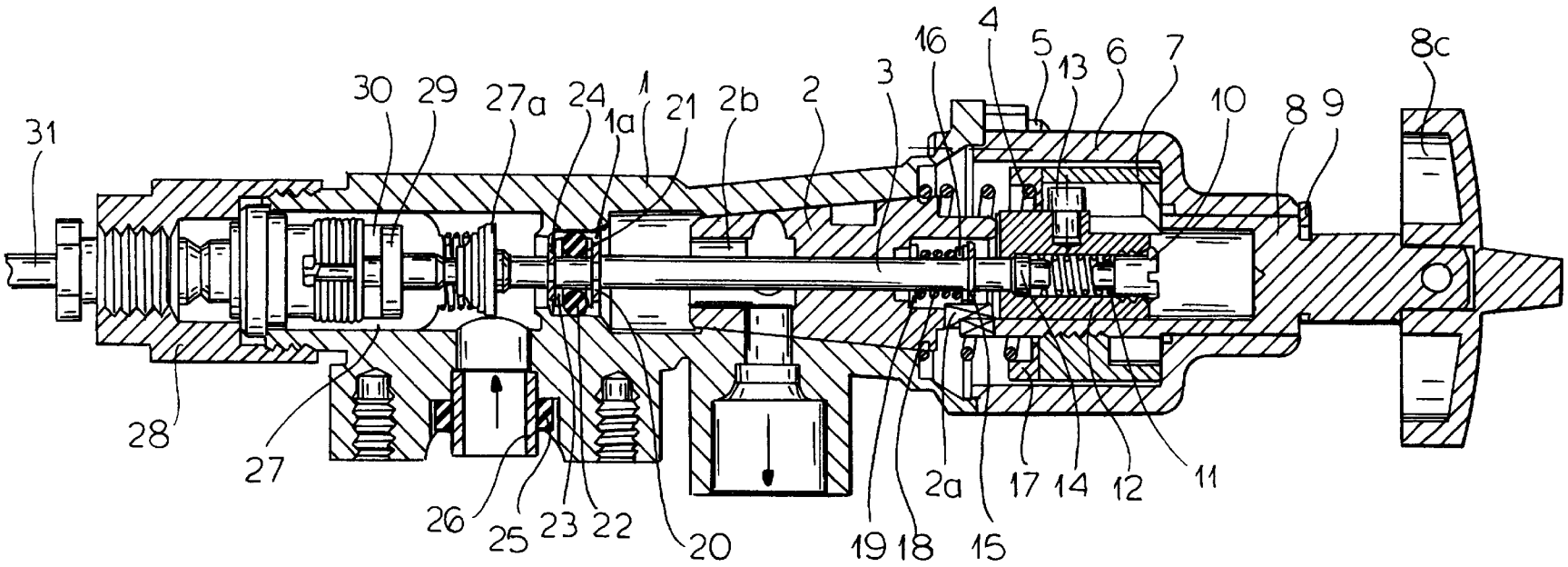
FIG. 2 is a section like FIG. 1 in an intermediate position.
Figure 3:
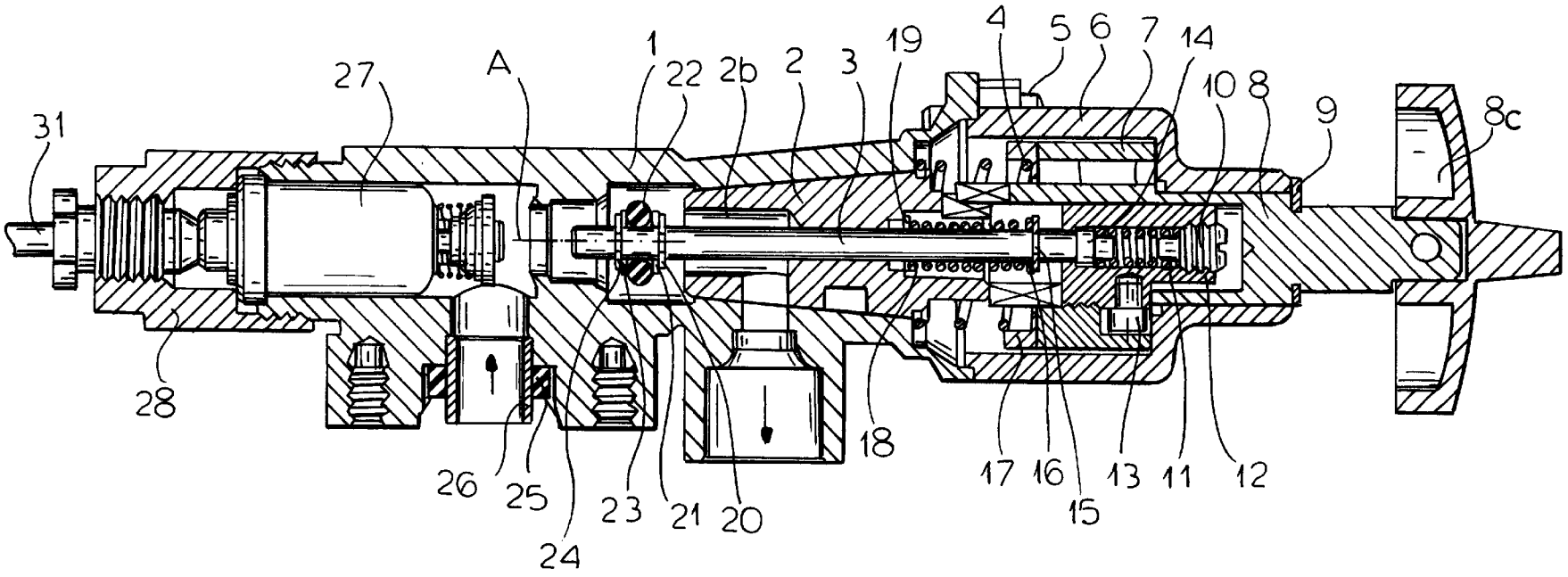
FIG. 3 is a section like FIG. 1 with both the main valve and safety valve open.

As seen in FIGS. 1 to 3, a gas cock or valve assembly according to the invention has a housing 1 centered on an axis A and formed with an axially extending passage 1*a* interconnecting a radial inlet port 1*b* connected to an unillustrated supply of gas and a radial outlet port 1*c* connected to an unillustrated burner or the like. A supply tube 26 is fitted to an O-ring 25 in the inlet port 1*a*. A plug-type valve body 2 is rotatable about the axis A in the housing 1 and is formed with an L-shaped passage 2*b* that can connect the outlet port 1*b* to an outer portion of the passage 1*a* as shown in FIGS. 2 and 3.

The valve body/plug 2 is formed with an axially outwardly open slot 2*a* into which fits an axially inwardly projecting finger formation 8*b* of a control shaft 8 that is fixed against axial displacement in a bore 6*a* of an outer part 6 of the housing 1 by a snap ring 9, a nut 5 securing the outer part 6 in place. Thus the shaft 8 and body 2 are rotationally coupled by the formations 2*a* and 8*b*. This shaft 8 also carries at its outer end a control knob 8*c* and is formed with a radially throughgoing and axially extending slot 8*a* in which engages an element 12 that can move axially but not angularly in the shaft 8.

The element 12 is provided with an outer abutment screw 10 against which bears the outer end of a compression spring 11 bearing at its inner end on an outer end 14 of a rod 3 extending axially through and axially slidable in the plug 3. Another spring 18 is braced between a pair of washers 19 and 16 respectively in turn braced against the plug 2 and against a snap ring 15 fixed on the rod 3 to urge the rod 3 axially outward. The spring 11 is stronger than the spring 18. An inner portion of the rod 3 carries a valve ring 22 held between washers 21 and 23 secured in place by snap rings 20 and 24 fitted to the rod 3. This valve ring 22 can fit snugly in the passage la to completely block flow through it as will be described below.

A safety shutoff 27 has a valve body 27*a* engageable over an inner end of the passage 1*a* so as to block it and a ferromagnetic inner end 29 that can engage an electromagnet or solenoid 30 carried in an end fitting 28 of the housing and connected via a line 31 to a thermocouple shown schematically at 32. In addition a controller 33 also operated by the valve shaft 8 is connected to this line 31 to feed electricity to the coil 30 as will be described below. A weak spring 27*b* urges the safety-shutoff body 27*a* outward into the closed position but the force of the solenoid 30 is enough when energized to hold it in.

Figure 6:
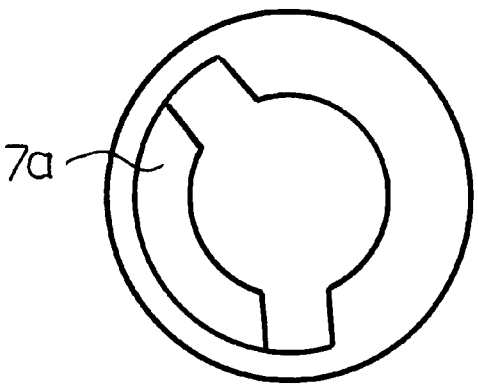
FIG. 6 is an end view of the cam.
Figure 5:
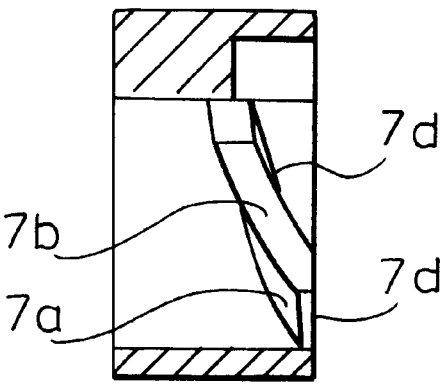
FIG. 5 is an axial section through the cam.
Figure 4:
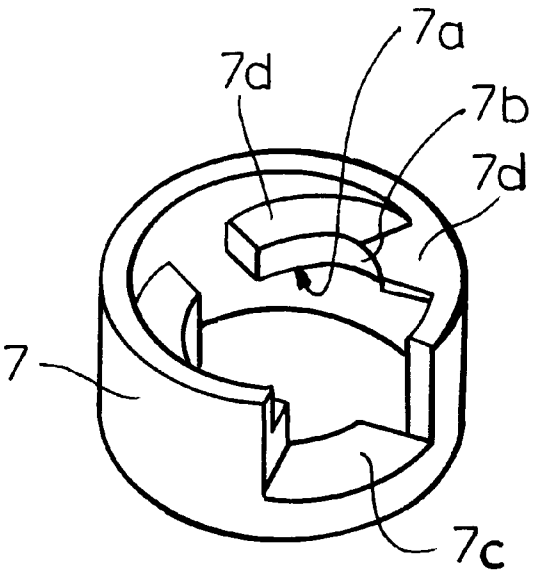
FIG. 4 is a perspective view of the cam of the valve.

A cam sleeve 7 shown in detail in FIGS. 4, 5, and 6 has a radially throughgoing slot fitted with a complementary formation in the housing part 6 so it can move axially but not angularly. A spring 4 bears at its inner end on the housing 1 and at its outer end on a disk 17 bearing axially outward on the cam sleeve 7 to urge it continuously axially outward. The sleeve 7 has a spiral ramp 7*b* with an inner face 7*a* and outer face 7*d*.

From the starting position of FIG. 1, clockwise rotation of the knob 8*c* will cause the abutment screw 13 to ride on the inner cam surface 7*a* and push the element 12 inward. Since the spring 11 is stiffer than the spring 18, this action will push in the stem 3 until the valve ring 22 fits into the passage 1*a* and blocks it. Shortly after the ring 22 has blocked this passage 1*a*, the inner end of the stem 3 will contact the valve body 27*a* and push it inward until the part 29 contacts the electromagnet 30. The controller 33 has meanwhile also been actuated by some connection with the knob 8*c* or shaft 8 to temporarily energize this electromagnet 30 so that it holds the element 29 with the valve 27 in its open position. Thus as shown in FIG. 2, the valve 27 is open, but the passage 1*a* is blocked by the element 22. Further rotation of the knob 8*c* once the part 29 bottoms on the electromagnet 30 will merely compress the spring 12 without moving the stem 3.

When the abutment 13 comes to the end of the inner cam face 7*a* it will drop off the end of it, moving axially outward under the force of the spring 18 so that the valve element 22 will be pulled out of the passage 1*a*, opening it and allowing gas to flow from the inlet 1*a*. This returns the stem 3 to the starting position as shown in FIG. 3, and the valve plug 2 is rotated so that its passage 2*b* allows maximum flow from the inlet 1*b* to the outlet 1*c*. Flow through the passage 1*a* can be regulated by changing the angular position of the plug 2 as the abutment 13 rides on the outer cam face 7*d*. Of course during this phase the entire sleeve 7 can be moved against the force of its spring 4. Meanwhile, presumably, the burner connected to the outlet 1*c* has been lit and the thermocouple 32 is detecting its heat and feeding sufficient electricity to the coil 30 to hold the shutoff 27 open and the temporary supply of electricity from the controller 33 has been cut off. Of course if the flame goes out, the coil 30 will be deenergized and the valve 27 will close as is standard.

When the knob 8*c* is rotated counterclockwise all the way back to the starting position in which flow through the plug 2 is no longer possible, the spring 18 will realign the inner cam surface 7*a* with the abutment 13 to allow the cycle to be re-started, that is with a clockwise rotation to the end position with the follower 13 riding on the inner cam face 7*a* to ignite the burner and counterclockwise rotation to control the flame height.

I claim:

1. A gas-valve assembly comprising:

a housing having an inlet port, an outlet port, and a passage extending between the ports and defining an axis;

a valve plug rotatable about the axis in the housing in the passage between a closed end position blocking flow between the ports and an open end position permitting flow between the ports;

a control knob rotatable on the housing and angularly coupled to the valve plug;

means engaged between the knob and the housing for preventing the knob from moving axially relative to the housing while permitting rotation of the knob about the axis relative to the housing;

a safety valve in the housing having a valve body displaceable axially between a closed position blocking flow through the passage and an open position permitting flow through the passage; and actuating means including a cam with a spiral cam surface and a cam follower riding on the cam surface and coupled to the knob for displacing the safety-valve body between its positions on rotation of the knob about the axis.

2. The gas-valve assembly defined in claim 1, further comprising means including formations inhibiting rotation of the cam about the axis and rotationally coupling the cam follower with the knob.

3. The gas-valve assembly defined in claim 2, further comprising an axially displaceable stem carrying the cam follower and having an end engageable with the safety-valve body.

4. The gas-valve assembly defined in claim 3 wherein the cam follower projects radially outward from the stem.

5. The gas-valve assembly defined in claim 3 wherein the cam is limitedly axially displaceable in the housing.

6. The gas-valve assembly defined in claim 5, further comprising means including a spring braced axially between the abutment and the stem for limited axial movement of the stem relative to the cam follower.

7. The gas-valve assembly defined in claim 5, further comprising means including a spring braced axially between the cam and the housing for limited axial movement of the cam in the housing.

8. The gas-valve assembly defined in claim 7 wherein the spring between the cam and the housing urges the cam axially outward toward the knob.

9. The gas-valve assembly defined in claim 7 wherein the spring between the cam follower and the stem urges the cam follower axially outward toward the knob and away from the safety valve.

10. The gas-valve assembly defined in claim 2 wherein the formations inhibiting rotation of the cam in the housing include an axially extending slot in the cam and a radially projecting part of the housing extending into the slot.

11. The gas-valve assembly defined in claim 1, further comprising axially extending and interfitting formations angularly coupling the knob to the plug.

12. The gas-valve assembly defined in claim 1 wherein in the open end position the cam follower is at an end of the cam surface.

13. The gas-valve assembly defined in claim 1 wherein the actuating means only displaces the safety-valve body into the respective open position in the open end position of the valve plug.

14. The gas-valve assembly defined in claim 1, further comprising control means including an electromagnet for temporarily holding the safety-valve body in the respective open position for a predetermined time after displacement of the safety-valve body into the open position by the actuating means.

15. The gas-valve assembly defined in claim 1 wherein the means preventing the knob from moving axially includes a snap ring engaged between the knob and the housing.

* * * * *